US008151616B2

(12) United States Patent
Isomäki

(10) Patent No.: US 8,151,616 B2
(45) Date of Patent: Apr. 10, 2012

(54) METHOD FOR MANUFACTURING ENCLOSURES OF A SHEET MATERIAL AND AN ENCLOSURE OF A SHEET MATERIAL

(75) Inventor: Ari Isomäki, Söderkulla (FI)

(73) Assignee: Ensto Finland Oy, Porvoo (FI)

( * ) Notice: Subject to any disclaimer, the term of this patent is extended or adjusted under 35 U.S.C. 154(b) by 727 days.

(21) Appl. No.: 11/990,556

(22) PCT Filed: Jun. 12, 2006

(86) PCT No.: PCT/FI2006/000190

§ 371 (c)(1), (2), (4) Date: Jan. 2, 2009

(87) PCT Pub. No.: WO2007/020319

PCT Pub. Date: Feb. 22, 2007

(65) Prior Publication Data

US 2009/0173742 A1 Jul. 9, 2009

(30) Foreign Application Priority Data

Aug. 15, 2005 (FI) ..... 20050824

(51) Int. Cl.

| | |
|---|---|
| ***B21D 31/00*** | (2006.01) |
| ***B21D 11/10*** | (2006.01) |
| ***B65D 6/28*** | (2006.01) |

(52) U.S. Cl. ..... 72/379.2; 72/379.4; 220/606

(58) Field of Classification Search ..... 72/379.2, 72/379.4, 473, 477, 478, 413, 411, 388, 319, 72/320, 322, 323, 465, 466, 472, 389.3; 220/606, 220/6, 7, 677, 678, 679, 680; 493/51–268

See application file for complete search history.

(56) References Cited

U.S. PATENT DOCUMENTS

| | | | |
|---|---|---|---|
| 6,412,325 | B1 | 7/2002 | Croswell |
| 2002/0184936 | A1 | 12/2002 | Gitlin et al. |
| 2004/0134250 | A1 | 7/2004 | Durney et al. |

FOREIGN PATENT DOCUMENTS

| | | |
|---|---|---|
| DE | 10020068 | 10/2001 |
| JP | 9141333 | 6/1997 |

*Primary Examiner* — Jessica L Ward
*Assistant Examiner* — Steven Ha
(74) *Attorney, Agent, or Firm* — Alfred A. Fressola; Ware, Fressola, Van Der Sluys & Adolphson LLP

(57) ABSTRACT

The invention relates to a method for manufacturing an enclosure of a sheet material and to an enclosure of a sheet material, which is manufactured of a sheet blank, of which the sides and the base of the enclosure have been folded, and the seams have been joined together. At least one corner to be folded of the enclosure is cut open from a part of the range in the sheet blank so that the unopened section corresponds to the smallest dimension to be folded in the product series of enclosures.

14 Claims, 6 Drawing Sheets

METHOD FOR MANUFACTURING ENCLOSURES OF A SHEET MATERIAL AND AN ENCLOSURE OF A SHEET MATERIAL

CROSS REFERENCE TO RELATED APPLICATIONS

This application is the U.S. National Stage of International Application Number PCT/fi2006/000190 filed on Jun. 12, 2006 which was published in English on Feb. 22, 2007 under International Publication Number WO 2007/020319.

TECHNICAL FIELD

The present invention relates to a method for manufacturing different-sized enclosures of (from) a sheet material.

The invention also relates to an enclosure of (from) a sheet material, which is manufactured of a sheet blank with folded sides and base of the enclosure and with seams joined together.

BACKGROUND OF THE INVENTION

In the manufacture of enclosures, it is a purpose of the invention to especially eliminate the setting times (setting need) relating especially to the folding and, simultaneously, to increase the flexibility of production so that the principal dimensions of the enclosure can be chosen freely (continuously). This increases considerably the possibilities of the enclosure manufacturer to customise the enclosure exactly according to the needs of the customer without an essential increase in the manufacturing costs in the form of tools to be obtained for special purposes and of setting times.

Another aspect that is simultaneously developed in the invention is the shape of the initial blanks. Because the common practice and starting point for the blank shape is a star blank, other alternatives for initial blanks i.e. sheet blanks are also the so-called L, T, S and H blanks, the advantage of which is to be seen in the possibility to more efficiently use the raw material, due to the bigger "empty" space and the better nesting of the blanks to the raw material sheet in relation to waste material. An enclosure of a sheet material can be made of any suitable material. It is essential that permanent deformation can be achieved to the material by folding, without causing any breakages to the material that could be considered damage. Materials suitable for this purpose, together with their different mixtures are, for example, several types of sheet material, steels, aluminium, copper, brass, certain plastics, etc.

DE 100 20 068 A1 is known from the state of the art, disclosing a method for manufacturing a box of a sheet material. In this publication, the folding lines are perforated so that it would also be easy to do the folding manually.

Also U.S. Pat. No. 6,412,325 B1 is known from the state of the art; here the folding lines of a blank of a box of a sheet material are also perforated before the folding of the actual box.

Also Patent Abstracts of Japan, publication number JP 09141333A is known from the state of the art; here a V-shaped folding slot is respectively processed to the folding line. In this case, the folding is easy, but the structure will stay intact, contrary to the folding of perforated sheets when there are perforation holes throughout the whole range of the fold.

The other solutions previously known have been based on the reduction of setting times with a robotised folding machine or on a completely automated folding machine. As solutions, these are more expensive, and they are based on the automated setting of tools and on the automated change of tools, not on the removal of the setting need itself. In the automated solutions, the initial blank used is typically a star blank, or a loose casing and base.

In the reduction of setting times, weaknesses of the said prior art automated systems are, among others, their price and dimensional restrictions. A continuous length of the folding seam is difficult to achieve, and as a tool covering the whole folding length needed, it is in practice almost impossible to realise in a rational manner. In addition, as the folding is in these cases made by a folding machine or a robot suitable for the purpose instead of a human-being, this will take time in any case.

SUMMARY OF THE INVENTION

It is an object of the invention that once a setting for enclosures of a certain size has been made to the folding machine, it will not be necessary to alter it when changing from one enclosure size to another, even if the size of the enclosure to be manufactured can be changed continuously.

When using a star blank as the initial blank for an enclosure of a sheet material, the disadvantage is the high probability of a high waste percentage of material, due to the star form. The area remaining in the corners of the sheet blank is relatively small and thus, difficult to use, and the blanks overlap poorly in relation to each other. Problems with a separate casing and base blank are again the measuring accuracy of the folds, the deformation of welding, long welding ranges, and how to get the base and the casing to the welding site at the same time (logistics).

It is an object of the invention to eliminate said drawbacks and to produce an enclosure of a sheet material, which can be manufactured quickly and easily without a separate setting step. It is also an object of the enclosure of the invention to offer an enclosure structure achieved essentially by folding, in which the length of the welding seams weakening the structure and vulnerable to corrosion are considerably small, compared with the competing solutions. It is an object of the invention to provide a method for manufacturing an enclosure of a sheet material, which provides the enclosure manufacturer with an economic and productive way to quickly and easily manufacture enclosures, the dimensions of which can be selected continuously, without tool setting steps reducing the production capacity. It is also an object of the invention to provide the user of the enclosure with freedom to continuously choose the size needed for the enclosure so that this does not cause any significant delay in the delivery or considerable additional costs in the form of the enclosure manufacturer charging the costs for special tools from the subscriber of an enclosure of a specific size.

The method of the invention for manufacturing an enclosure of a sheet material is characterised in that it includes the following steps:

- selecting the biggest folding length for the enclosures to be manufactured, and the respective first folding tool,
- selecting the smallest folding length for the enclosures to be manufactured, and the respective second folding tool,
- preparing the sheet blank for an enclosure of a sheet material for folding,
- making an open-cut section to a folding line, in which folding line the length of the unopened section corresponds to the selected second folding tool,
- folding the corners of the sheet blank by means of the first folding tool, with the exception of the last folding,
- folding the last corner by means of the second folding tool by using the tool on the unopened section,
- locking the folded enclosure to its shape.

It is characteristic of the enclosure of a sheet material produced by the method of the invention that one corner to be folded of the enclosure is cut open for a part of the range in the sheet blank so that the open-cut section together with the unopened section forms a rectilinear folding line and one of the corners between the walls of the enclosure.

In connection with this invention, the term "unopened" refers to a folding edge at the intersection of two planar walls of an enclosure of a sheet material or to a line in the blank of an enclosure of a sheet material, which line will be folded at a later manufacturing step, which section not cut open in the sheet is substantially uniform. For example, a folding edge made directly to the sheet is "unopened". The term "open-cut" again refers to the respective point disclosed above, which is completely or substantially cut open so that the material strength in the direction of thickness of the sheet is considerably smaller, such as 0, than elsewhere. The purpose of the "cutting open" is to achieve an edge to be folded with a considerably low bending resistance, i.e. folding line.

With the invention, it is possible to reach a situation, in which no setting times are needed and the whole product series of enclosures of different sizes that have been planned for manufacturing can be manufactured by means of only two folding tools used for the folding of corners. The first folding tool is a so-called wide folding tool, the width of which is bigger or equal to the biggest folding length of the enclosures to be manufactured. The second folding tool again is of the width of the smallest folding length for the model series of enclosures planned to be manufactured. Naturally, in addition to the said first and second folding tool, other folding tools, such as forming tools, can be used for other details of the enclosure, for example, for the formation of the orifice. An open-cut section is prepared to the sheet blank to at least one and preferably to only one point of the edge to be folded so that the unopened length at the edge in question corresponds to the width of the second folding tool. In other words, the corner of the initial blank will have to made in the following manner (which can also be seen in the Figures). The initial blank can be any of the following: a star, L, S, T or H. It is essential that at least one corner is cut open in a manner shown in the figure and that, in the present invention, it is unopened for a range which is the same as the smallest folding length of the enclosures in the product series, thus equalling the width of the second folding tool. In the case in the figure, the corner has been cut open for a uniform range so that, for example, the dimension according to the lowest enclosure in the product series is selected for the width for the folding tool inside the enclosure. The product series refers to the determination of the sizes of the enclosures to be produced so that an enclosure to be manufactured with the biggest folding length is chosen, and the folding edge with the shortest folding length or the shortest folding edge to be folded last at the intersection of two planar walls is chosen so that the product series comprises continuously all enclosures between these chosen dimensions.

Thus, in the model or product series of enclosures of a sheet material, the relation between the said open-cut length and the unopened length is such that the length of the open-cut corner in the enclosure with the smallest folding length in the product series is 0. In enclosures bigger than the smallest enclosure, the unopened length is according to the smallest length to be folded of the said smallest enclosure, and the open-cut length comprises the rest of the length of the last corner to be folded of the enclosure.

With a finished enclosure of a sheet material the use of the method can be observed so that, upon comparing two enclosures of different sizes by the same manufacturer, both these enclosures advantageously have an unopened folded corner of the same dimension in only one angle, and the rest of the length of the corner has been cut open and joined again. In this case it is obvious that at least one corner to be folded of the enclosure is cut open for a part of the range in the sheet metal blank so that the length of the uniform folding of the corner in question corresponds to the shorter of the two tools used, and the folding sequence has been selected so that the folding tool may extend outside the enclosure in the other corners.

The folding sequence is selected so that the open-cut corner will be the last one to be folded, because in this case it is no longer possible to use an overwide folding tool, the first folding tool, but one needs a folding tool, which can fit into the enclosure, i.e. the second folding tool. After the enclosure has been completed, the open-cut section in the blank will be closed by welding, and other possible connections will be performed, such as fastening by welding. With the correct folding sequence, it is thus possible to reach such a situation in which no settings need to be made to the folding machine, but the folding will be made in an order, in which a long tool, the first folding tool, will be able to come "out of the enclosure" in connection with the first folds, and the last fold (folds) will be made with a short tool, the second folding tool, in a corner partly cut open. It is to be noted that there may be one to four open-cut corners. It depends on this, with how many tools the enclosures can be made (either with two or three blades).

The benefit of the invention with regard to the setting time and logistics is considerable, because, after this, as the folding machine and the robot serving the sheet blank to it are aware of the working sequence, the size category of the enclosure is no longer of significance. At the same time, it will be possible to manufacture new enclosure sizes according to dimensions freely selected by the customer in an economic and efficient manner. By adopting the use of an initial blank of another type, considerable saving in the raw material waste will also be achieved.

BRIEF DESCRIPTION OF THE DRAWINGS

The invention will next be explained by means of an example, referring to the enclosed drawings, in which.

DETAILED DESCRIPTION

An enclosure will be manufactured of a sheet blank so that the sides 4 and the base 5 of the enclosure will be folded and the seams will be fastened, the corner 6 to be folded of one enclosure being cut open 7 for a part of the range in the sheet blank. The manufacturing steps will next be explained in more detail by means of the enclosed figures.

Figure 1:
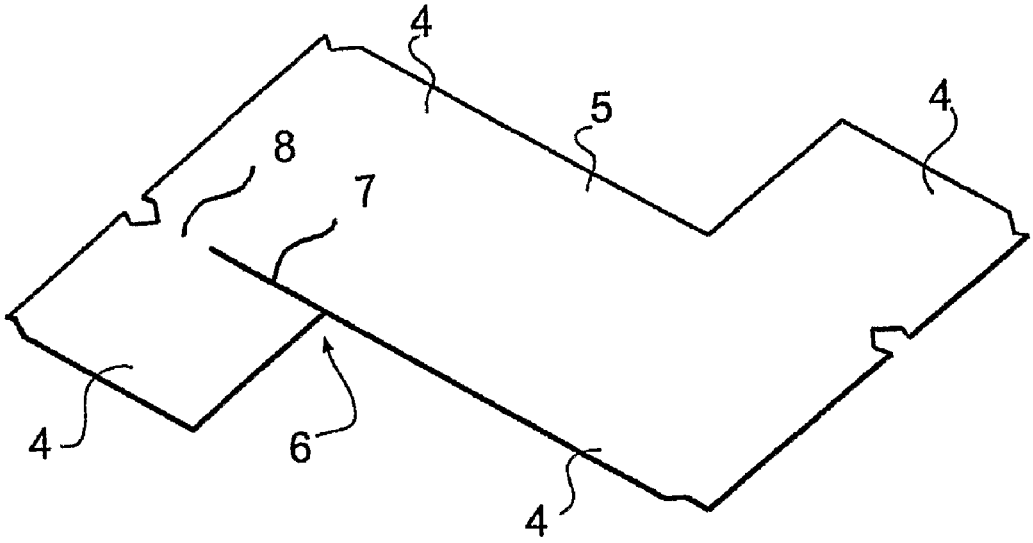
FIGS. 1-7 illustrate the folding of an enclosure from an S-shaped blank to a finished enclosure.
Figure 2:
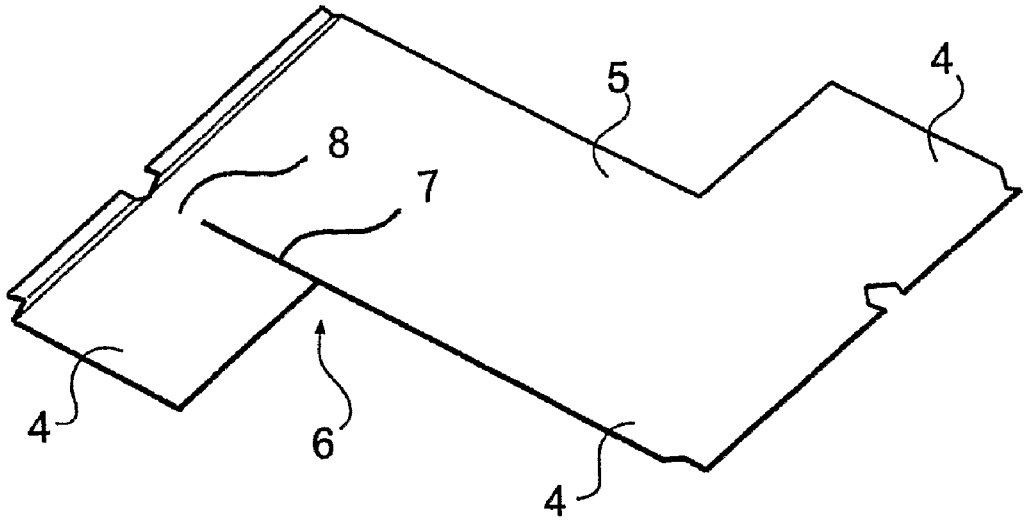
Figure 3:
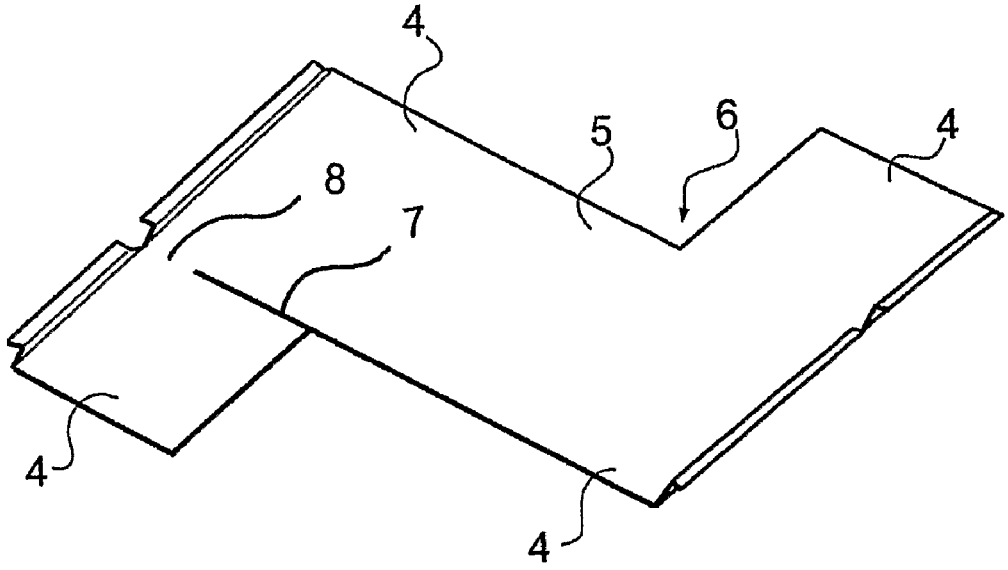
Figure 4:
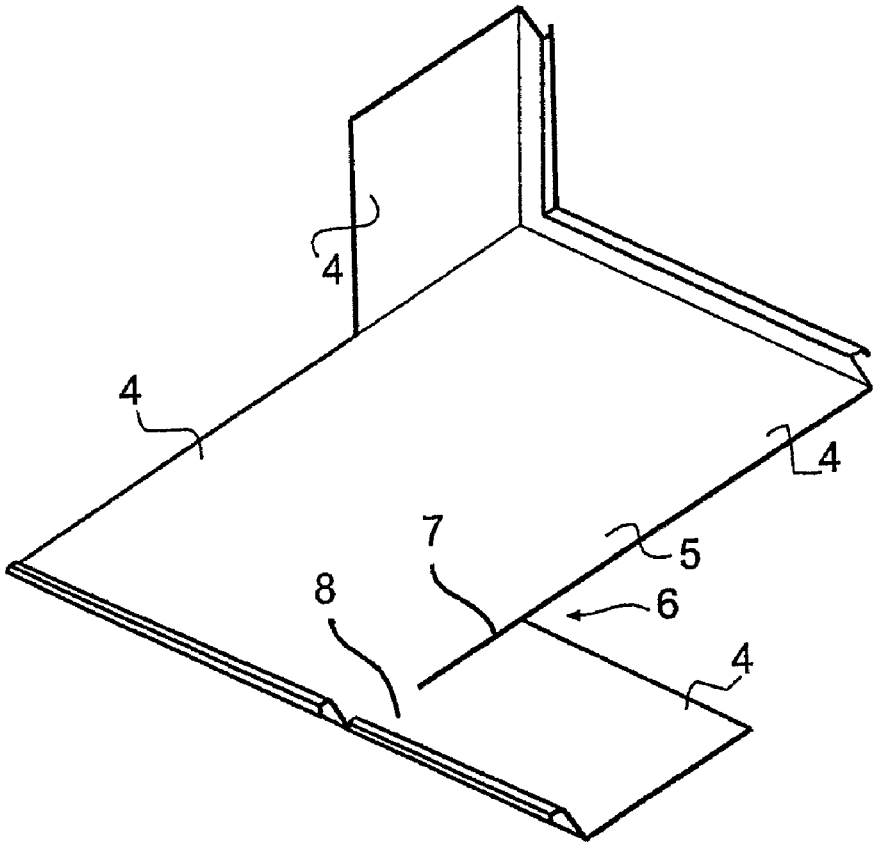
Figure 5:
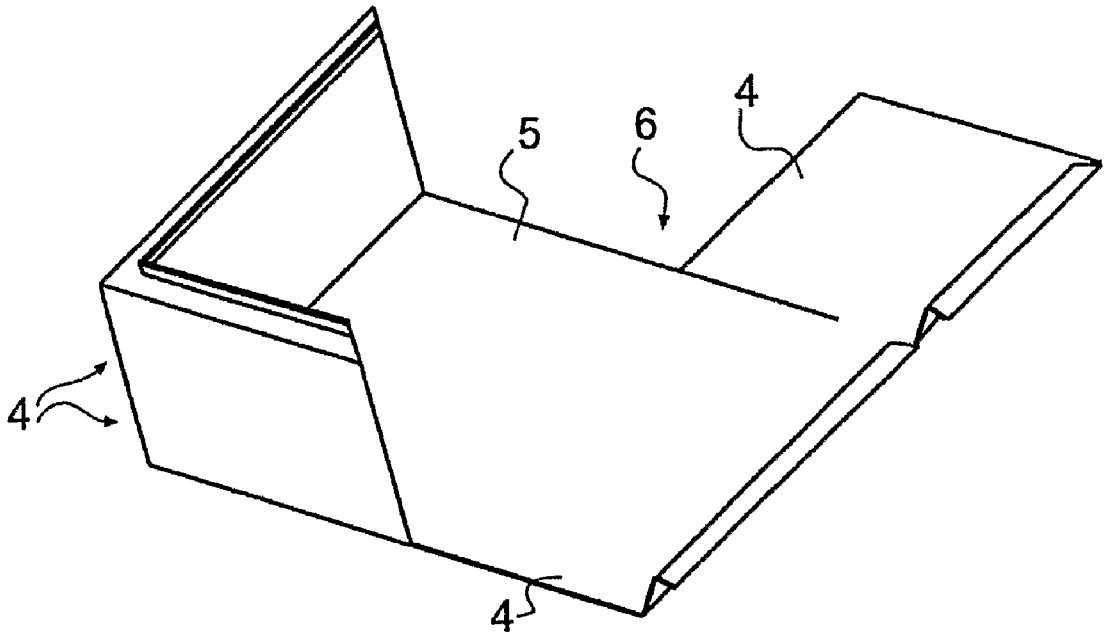
Figure 6:
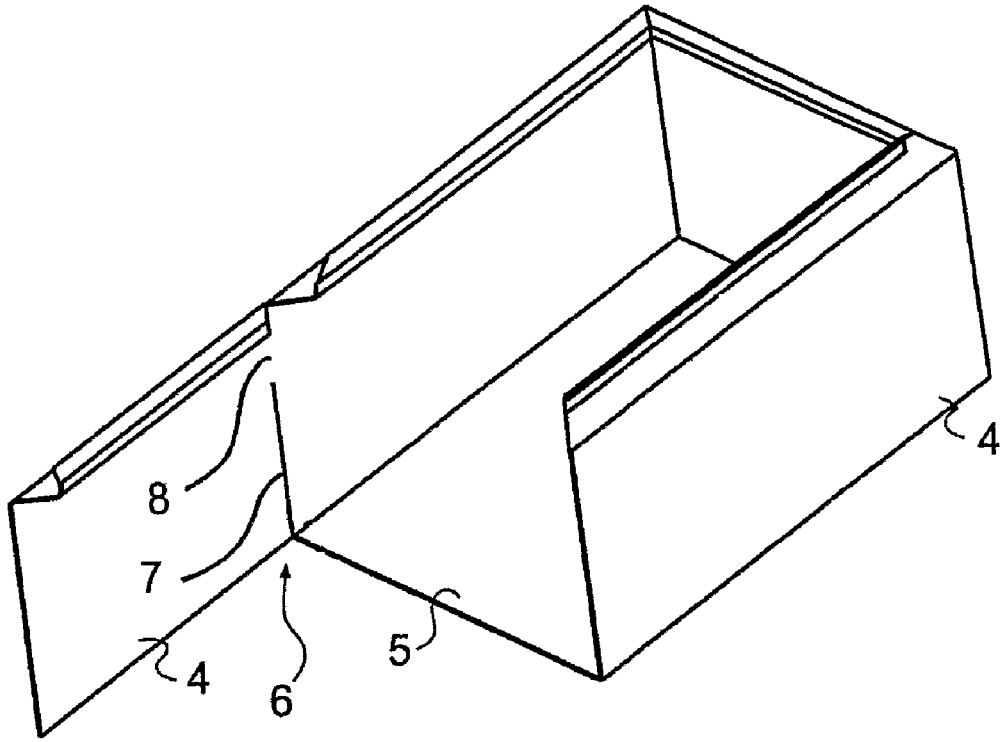
Figure 7:
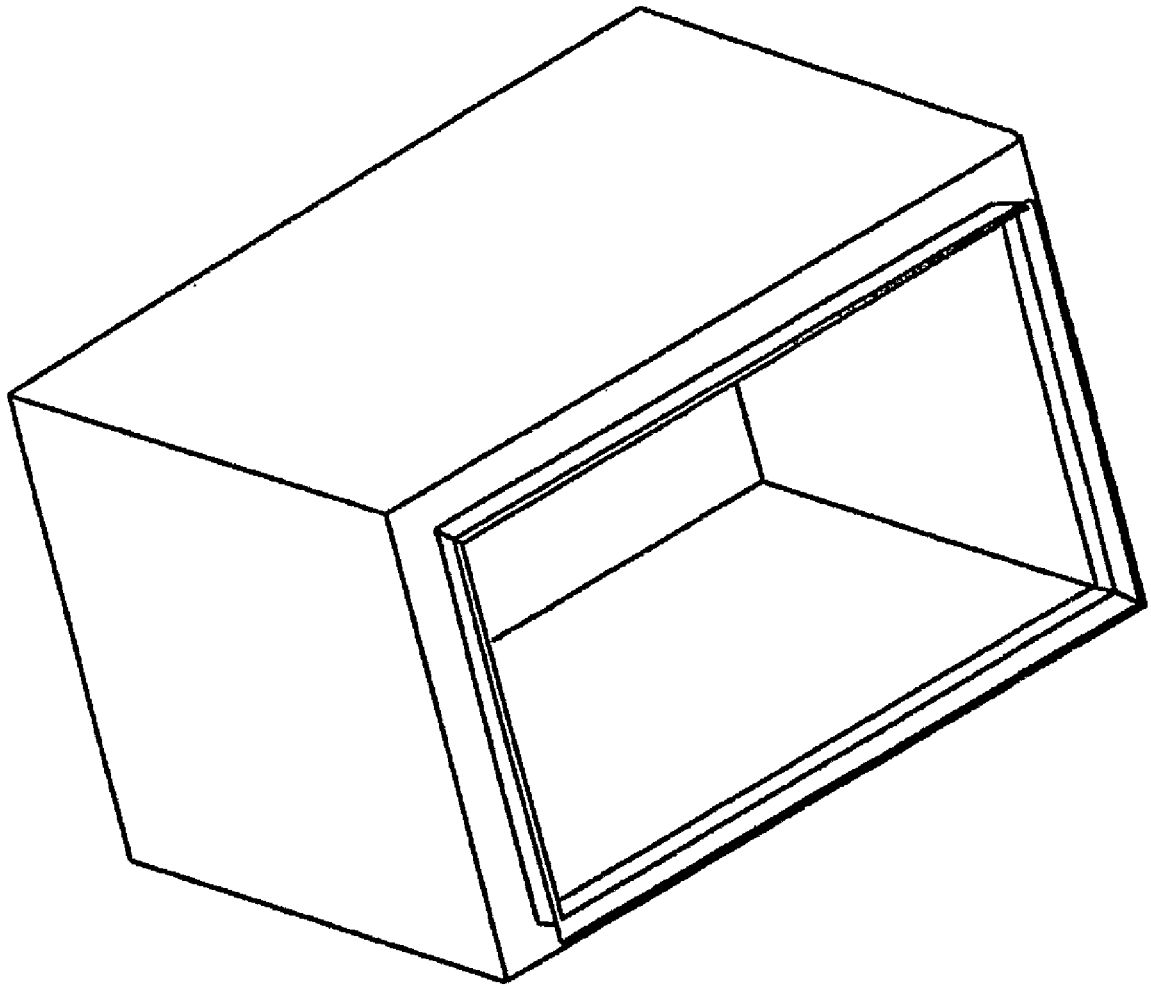
Figure 8:
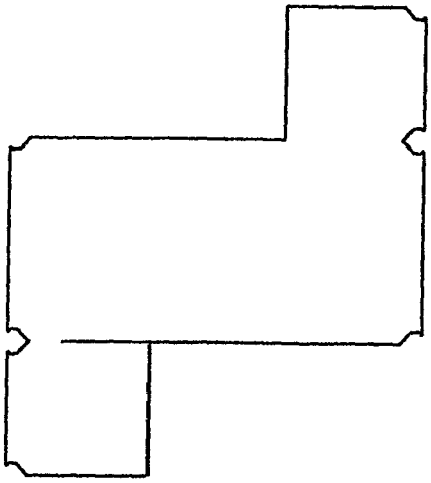
FIGS. 8-12 illustrate sheet blanks of different shapes, a similar final result being achieved with all of them.
Figure 9:
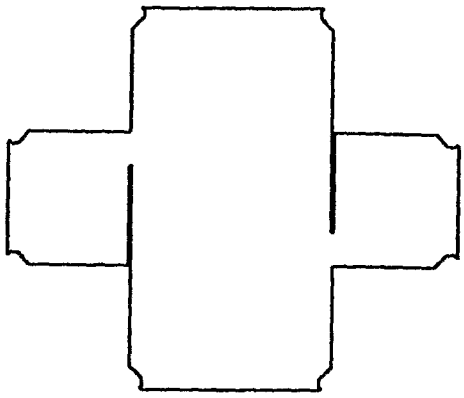
Figure 10:
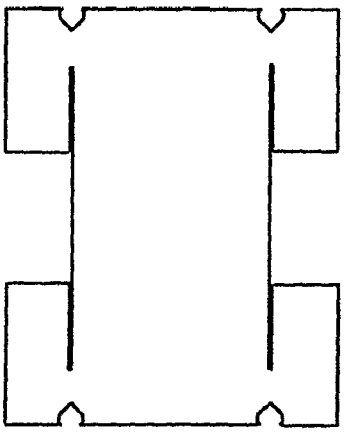
Figure 11:
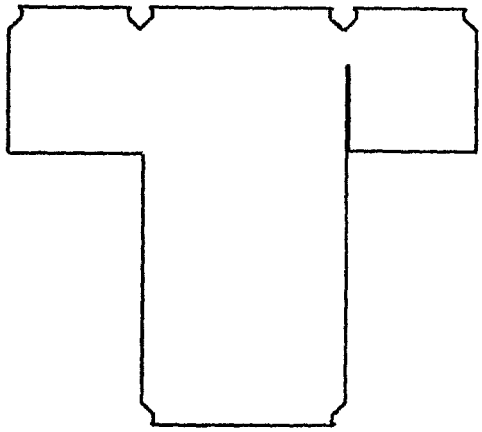
Figure 12:
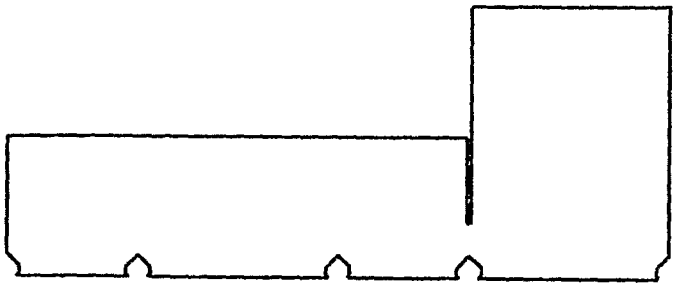
Figure 13:
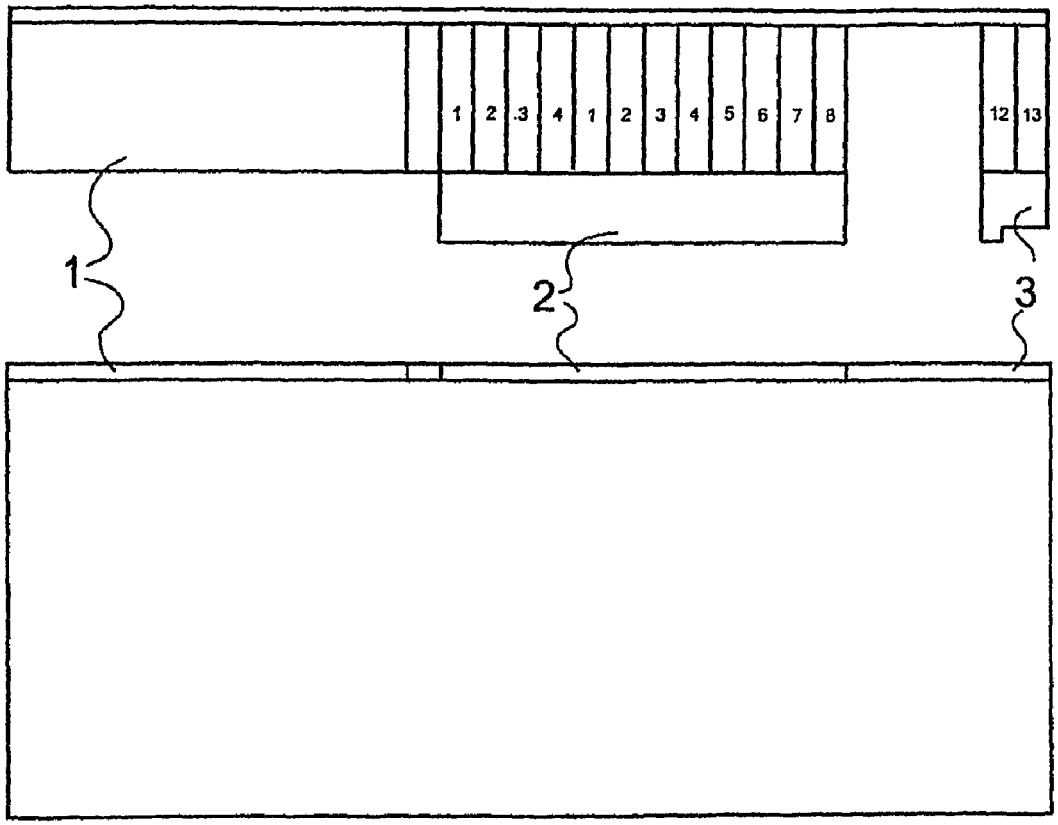
FIG. 13 illustrates the upper and lower section of the folding machine.

The sheet blank is cut to the desired shape, in this example to the S-shape. After this, the product blanks will be taken to the folding machine. The folding machine has a blade setting according to the FIG. 13 using three different folding tools 1, 2 and 3 made to it. In this example, a separate forming tool 1 is used for folding the orifice; long folds will be made with the first folding tool 2, and the folding of the open-cut corner will be made with the second folding tool 3. When using these folding tools, the folding sequence is the following: Folding the two first edges of the orifice with the forming tool 1, FIG. 2, after which the first corner between the two sides will be folded with the first folding tool 2, FIG. 3. After this, the two latter edges of the orifice will be folded with the forming tool 1, FIG. 4, and the first folding tool 2 will then be used for folding the two corners between the bottom and the side, FIGS. 5 and 6. Then, the open-cut last corner between the sides will be folded with the second folding tool 3 so that the enclosure will be closed. After this, the enclosure will be ready for welding. Thus, the basic principle in this example is the use of three fixed folding tools so that one of these, the forming tool 1, will be used for folding the shape of the orifice. The width of the folding tools can be chosen according to the maximum dimensions of the product series, because the folding tool 1,2 can always "come out of the enclosure". The first folding tool 2 will be used for folding all such corners, in which the folding tool will extend "out of the enclosure" from at least one end so that the width of the folding tool can still be chosen according to the maximum dimension. The second folding tool 3 will be used for folding the corners in a case, in which the enclosure is already closed so that the blade cannot come freely "out" of the enclosure. The width of the folding tool can be chosen according to the smallest dimension to be folded in the product series, and the folding line of the sheet blank will be cut open for the section, which exceeds the width of the second folding tool 3 as the size of the enclosure increases. In this case, the unopened section 8 of the corner 6 is uniform, and its length is at most of the size of the shortest side or of the shortest side to be folded last in a product series of different-sized enclosures of a sheet material. When, in practice, the enclosures always have a light aperture, the shape will eventually become so closed that it is preferable to fold at least one corner by means of the method of the present invention.

The edge shape of the orifice can also be folded with the first folding tool 2 by using two or several successive folding steps for providing the shape. In this case, the number of folding tools will decrease (no forming tool 1 will be needed), but the number of folding strokes will increase. The seams of the enclosure can be joined or locked by welding, glue, rivets, or screws. The corners of the enclosure can be welded also at the unopened section 8. According to an advantageous embodiment, the end of the open-cut section 7 at the edge of the sheet blank there is a short unopened isthmus for guiding the folding edge in a desired way and for reducing the deformations of the open-cut to be welded or joined otherwise.

As in this case, the starting point is at least one open-cut corner 6, and the length if the fixed section of the corner has been chosen according to the enclosure with the smallest dimension in the product series, it is no more of significance, from which end the corner is open or if it is open from both ends, or if one corner or all four corners are cut open, or of the fixed section in the corner is uniform or not. Of the sheet blank models, S, T and L are the most interesting ones, because in these, the material waste is most often the smallest. At the end points, the open-cut section 7 can be different from the other parts, e.g. V-shaped so that the location of the sheet edges after the folding in relation to each other can be made advantageous with regard to joining, such as welding. The sheet blank or the section 7 of the open-cut corner to be folded in the blank can advantageously be cut, for example, by laser or water cutting.

A corner partly cut open, with narrow isthmuses, may be needed either for totally eliminating the internal tool or for optimising the folding shape, for example, in relation to welding or appearance when using the internal tool. Instead of a straight open cut, for example, a V-shaped form can be used for optimising the folding shape at the end points so that the edges of the sheet can be positioned into a more advantageous position in relation to each other, for example, for welding. Thus, there may be open-cut sections 7 in the corner 6 to be folded last on both sides of the unopened section 8.

What is claimed is:

1. A method for manufacturing different-sized enclosures of a metal sheet material, comprising:

selecting a biggest folding length for the enclosures to be manufactured and a respective first folding tool (2), selecting a smallest folding length for the enclosures to be manufactured and a respective second folding tool (3), preparing a metal sheet blank (4, 5) for an enclosure of the metal sheet material for folding, making an open-cut section (7) adjacent to an unopened section (8), wherein the length of the unopened section (8) corresponds to the width of the second folding tool (3), folding corners of the metal sheet blank (4, 5) by means of the first folding tool (2), with the exception of a last folding, folding a last corner (6) by means of the second folding tool (3) by using the second folding tool on the unopened section (8), and locking the folded enclosure into its shape.

2. The method according to claim 1, wherein an enclosure is manufactured of the sheet blank so that sides (4) and a base (5) of the enclosure are folded and seams are fastened, with one corner (6) of the metal sheet blank to be folded being cut open (7) for a part of the range in the metal sheet blank.

3. The method according to claim 1, wherein the unopened section (8) of the corner (6) has a length that is at most of a size of a shortest side to be folded in a product series of different-sized enclosures of a metal sheet material.

4. The method according to claim 1, wherein the unopened section (8) of the last corner (6) has a length that is at most of a size of a shortest side to be folded last in the product series of different-sized enclosures of a metal sheet material.

5. The method according to claim 1, wherein at an end of the open-cut section (7) at an edge of the metal sheet blank there is a short unopened isthmus for guiding a folding edge in a desired way and for reducing deformations in the open cut to be welded.

6. The method according to claim 1, wherein there are open cut sections (7) in the corner (6) to be folded last on both sides of the unopened section (8).

7. The method according to claim 1, wherein the metal sheet blank (4, 5) is cut by a laser or by water cutting.

8. The method according to claim 1, wherein the open-cut section (7) of the corner to be folded in the metal sheet blank has been cut by a laser or by water cutting.

9. The method according to claim 1, wherein at its end points, the open-cut section (7) has ends that are of a different shape than other corners, so that the location of sheet edges after the folding in relation with each other are advantageous for joining.

10. The method according to claim 1, wherein the corners of the enclosure are welded at the unopened sections (8).

11. The method according to claim 1, wherein seams of the enclosure are joined or locked by welding, glue, rivets, or screws.

12. The method of claim 9, wherein the joining is by welding.

13. The method of claim 9, wherein the open-cut section (7) is V-shaped.

14. The method of claim 13, wherein the joining is by welding.

* * * * *